US005970557A

United States Patent [19]

Supra

[11] Patent Number: 5,970,557

[45] Date of Patent: Oct. 26, 1999

[54] POOL CLEANING DEVICE

[76] Inventor: Carl Frederick Wilhelm Supra, P.O. Box 1756, Rivonia 2128, South Africa

[21] Appl. No.: 08/915,685

[22] Filed: Aug. 21, 1997

[51] Int. Cl.[6] ..... E04H 4/16

[52] U.S. Cl. ..... 15/1.7

[58] Field of Search ..... 15/1.7

[56] References Cited

U.S. PATENT DOCUMENTS

| | | | |
|---|---|---|---|
| 4,023,227 | 5/1977 | Chauvier | 15/1.7 |
| 4,133,068 | 1/1979 | Hofmann | 15/1.7 |
| 4,208,752 | 6/1980 | Hofmann | 15/1.7 |
| 4,351,077 | 9/1982 | Hofmann | 15/1.7 |
| 4,769,867 | 9/1988 | Stoltz | 15/1.7 |
| 5,706,540 | 1/1998 | Niewiarowski | 15/1.7 |

FOREIGN PATENT DOCUMENTS

| | | | |
|---|---|---|---|
| 559477 | 9/1993 | European Pat. Off. | 15/1.7 |

*Primary Examiner*—Mark Spisich
*Attorney, Agent, or Firm*—Young & Thompson

[57] ABSTRACT

A pool cleaning device which has an integrally moulded body in which are formed a valve chamber, an outlet chamber and two passages which extend between the valve chamber and the outlet chamber. A valve member is captive inside the valve chamber. Buoyancy and biasing components are located inside the moulded body.

3 Claims, 3 Drawing Sheets

POOL CLEANING DEVICE

BACKGROUND OF THE INVENTION

This invention relates to a swimming pool cleaning device and to the manufacture thereof.

Swimming pool cleaners known to the applicant are formed from a plurality of interconnected parts. Most of the parts are manufactured using injection moulding techniques. The moulds which are required for injection moulding are expensive and the interconnection of the various parts can be an expensive and laborious process.

Some pool cleaners, particularly of the suction type, make use of a valve mechanism which repeatedly interrupts or reduces the rate of water flow through the pool cleaner. It has been found that the resulting stresses can loosen the mechanisms which fasten the parts of the pool cleaner to each other or can generate stress lines at the points at which the fastening devices are engaged with the pool cleaner parts. The stem lines can fracture the cleaner.

SUMMARY OF THE INVENTION

The invention provides a method of forming a pool cleaning device which includes the steps of forming a core, moulding at least a section of a body of the device around the core, and removing the core to form a cavity inside the moulded body section.

The core may be removed in any appropriate way. For example the core may be formed from wax or any other similar material and core may be melted whereafter the molten core may be permitted to flow from the body section.

In a variation of the invention the core is formed from a material which can be dissolved using a suitable solvent. The dissolved core is then permitted to flow from the body section. The core may for example be made from a material such as polystyrene and the solvent may be acetone or a similar substance.

In one variation of the invention the cavity is formed with a valve chamber and a valve member is located in the valve chamber.

The valve member may be located in the cavity, after the cavity has been formed, by inserting the valve member through an aperture, in a wall of the body section, into the valve chamber.

Alternatively the body section may be moulded around the valve member which is held captive in the valve chamber after the core is removed. The valve member may for example be embedded in or attached to the core and be left behind after the core is removed.

A flotation chamber, and a biasing chamber, may be formed in the body section.

In a preferred embodiment of the invention the core is formed so that the cavity includes a valve chamber with an inlet through a wall of the body section, an outlet chamber with an outlet through a wall of the body section, and two passages which extend between the valve chamber and the outlet chamber.

The invention also provides a method of forming a pool cleaning device which includes the steps of moulding at least a section of a body of the device around means which defines a valve chamber, and thereafter removing the said valve chamber defining means to expose a valve chamber.

The invention further extends to a pool cleaning device which includes an integrally formed body section in which is defined a valve chamber, an inlet to, and an outlet from, the valve chamber, and a valve member which is mounted for movement inside the valve chamber.

A flotation component and a biasing component may be located within the body section.

The invention also provides a core for forming a cavity inside a moulded body of a pool cleaning device, the core including a section which defines a valve chamber, a section which defines an outlet chamber, and an intermediate section which defines two passages which extend between the valve chamber and the outlet chamber.

Each passage preferably in cross-section is substantially D-shaped.

The core may be provided in combination with a buoyancy component which is attached to or included in the core.

The core may be made from any material which can be dissolved or melted using an appropriate medium. The core may for example be made from polystyrene or wax. In the former case the core is dissolvable using a solvent such as acetone. In the latter case the core can be melted by raising its temperature using any suitable heating means.

BRIEF DESCRIPTION OF THE DRAWINGS

The invention is further described by way of examples with reference to the accompanying drawings in which.

DESCRIPTION OF PREFERRED EMBODIMENTS

Figure 1A:
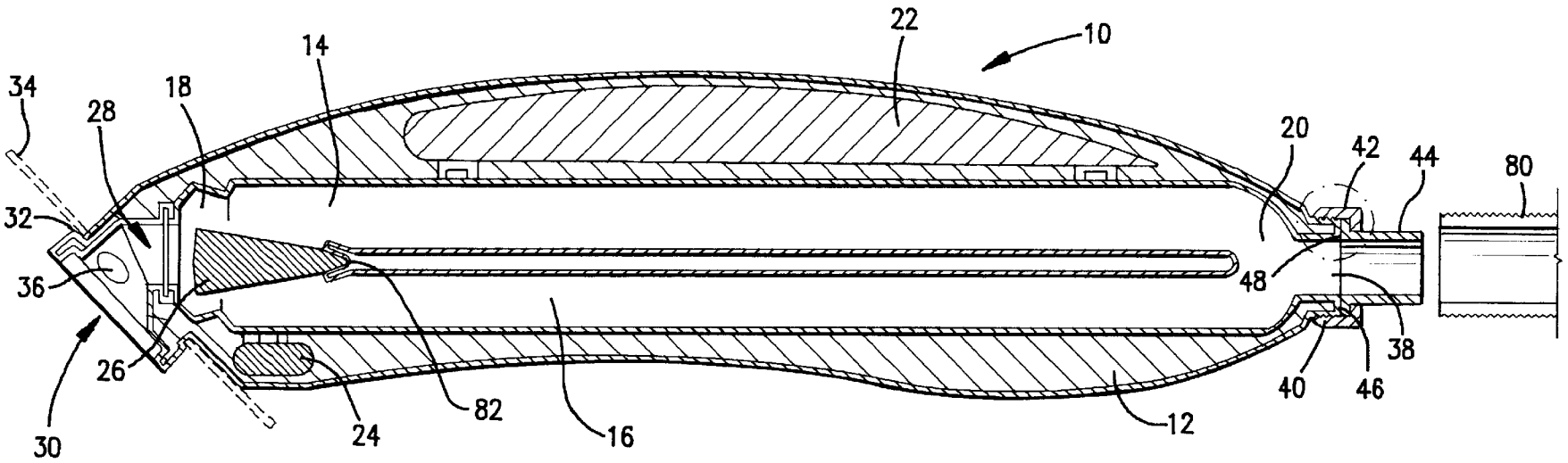
FIGS. 1A and 1B are sectioned side views of a pool cleaning device manufactured in accordance with the principles of the invention.
Figure 1B:
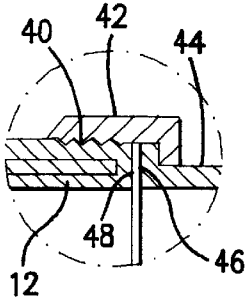

FIG. 1A and 1B of the accompanying drawings illustrate in cross-section, a pool cleaning device 10 according to the invention which operates with suction flow produced, in this case, by a swimming pool pump which subsequently directs water flow through a filtration system before returning it to the pool. The general arrangement is known in the art and consequently is not described in detail herein.

The cleaner 10 includes a body 12 and, located within the body, two tubes 14 and 16 respectively which extend between a valve chamber 18 near one end of the body and an outlet chamber 20 near an opposed end of the body. A buoyancy or flotation component 22 and a biasing component or weight 24 are encased in the body 12.

A valve member 26 is held captive in the chamber 18 which has a restricted inlet 28. The valve member is made from any suitable material e.g. polyurethane.

The body 12 has a mouth 30 and, optionally, a shoulder formation 32 on which is mounted a suction skirt, cleaning flaps or the like, shown in dotted outline 34. An optional aperture 36 is formed in a wall of the body adjacent the mouth.

The outlet chamber 20 has an outlet 38 which is surrounded, on an outer surface of the body, by thread 40. A union nut 42 is engaged with the thread and couples a spigot 44 to the outlet 38. The spigot has a shoulder 46, of fairly large area, which bears on the material 48 of the body surrounding the outlet 38. The spigot 44 is rotatable about its axis but otherwise is securely attached to the body 12.

The union nut 42 and the spigot 44 are formed separately from the body 12 using any suitable technique e.g. an injection moulding process.

The flotation component 22 could comprise an air pocket but, in a preferred embodiment of the invention, use is made of a lightweight material such as polystyrene.

The weight 24 is preferably formed from a moulded lead member.

The entire cavity inside the body 12 is initially defined by means of a polystyrene core. Thus a single core is formed which includes a section which defines the valve chamber 18, a second section which defines the outlet chamber 20, and two elongate sections which form the respective tubes 14 and 16. The valve member 26 may be embedded inside the polystyrene which forms the valve chamber 18.

A core of the kind described is prefabricated under controlled conditions using suitable moulds.

Preferably the core also includes a section which defines the mouth 30.

It is advantageous to form the core as an integral piece i.e. the various core sections are formed at the same time in a single moulding process. It is however possible to form the core from separate sections which are secured to one another in any appropriate way. Another variation is to form the core sections which form the chamber 18 and the mouth 30 as one piece and the core section which defines the outlet chamber 20 as a second piece. The two core pieces may then be connected to one another using tubes which replace the core sections which otherwise would have been formed from polystyrene.

Figure 3:
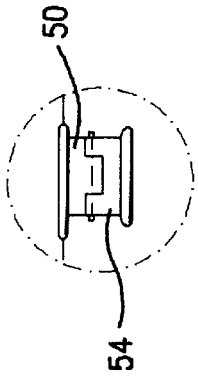
FIG. 3 is an enlarged view of a portion of the drawing of FIG. 2, and illustrates the way in which a buoyancy component and biasing component are included in the body of the pool cleaning device.
Figure 2:
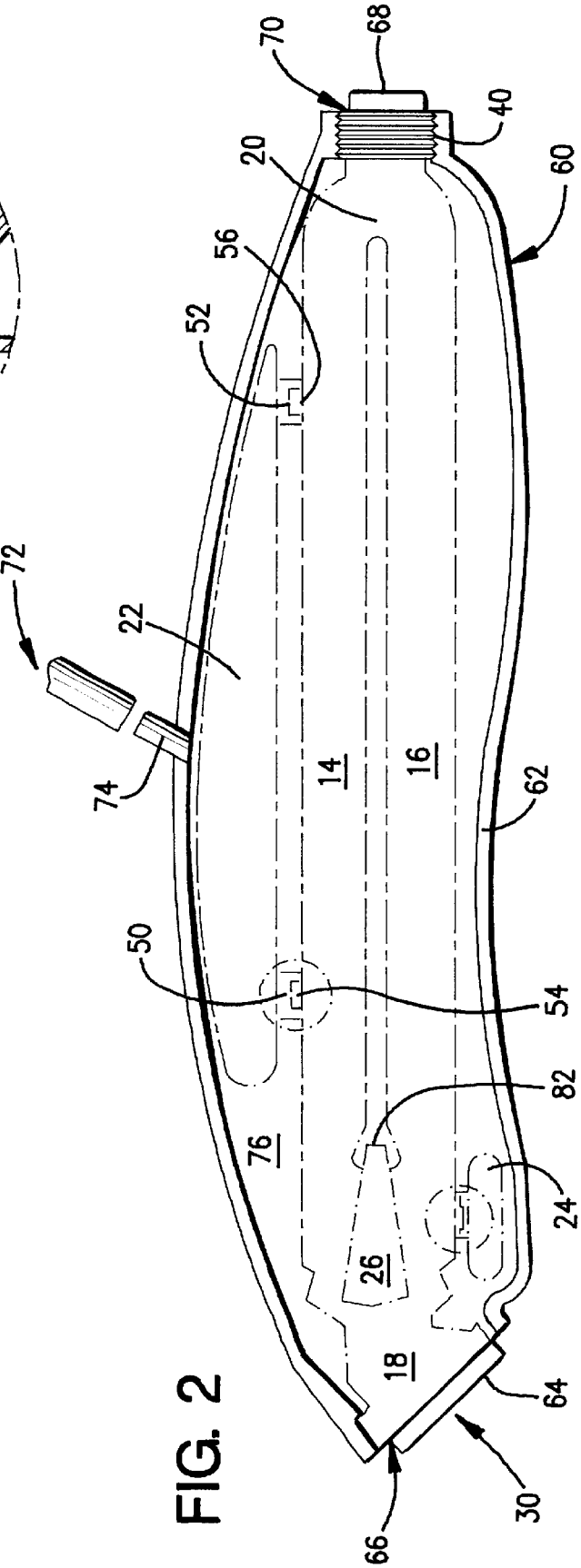
FIG. 2 illustrates, somewhat schematically, a moulding step during the manufacture of the device.

FIGS. 2 and 3 illustrate the way in which the buoyancy component 22, which is preferably made from polystyrene which is formed separately from the core, is attached to the core. Use is made of small plastic pins 50 and 52 which are partly embedded in the polystyrene component 22 and which extend from the component at predetermined locations. Complementary pins 54 and 56 respectively are embedded in the polystyrene core section which ultimately will form the tube 14. The pins 50 and 54 on the one hand and 52 and 56 on the other hand, have complementary interengageable formations which enable the component 22 to be attached to the core substantially as illustrated in FIG. 3.

The biasing component 24 may be attached in a similar manner to the core section which ultimately will define the valve chamber 18.

FIG. 2 illustrates a mould 60 which is formed in two halves, although only one half is visible in FIG. 2. The two mould halves have surrounding rims 62 which mate with each other on a centre line of the body 12, in the longitudinal direction of the body. The preformed polystyrene core which, as has been noted, comprises sections which define the mouth 30, the valve chamber 18, the tubes 14 and 16, and the outlet chamber 20, has the polystyrene buoyancy component 22 and the biasing component 24 attached to it. The valve member 26 is embedded in the polystyrene section which forms the chamber 18—this polystyrene is simply moulded around the member 26. The composite core assembly is then placed inside one of the mould sections.

Preferably, as is shown in FIG. 2, the core section which defines the mouth 30 has a small projection 64 which extends through an opening 66 formed by the mating mould halves. Similarly the core section which defines the outlet chamber 20 has a small projection 68 which extends through an aperture 70 formed by the mating mould halves. The projections 64 and 68 engage with the apertures and ensure that the core assembly is correctly positioned inside the mating mould halves which thereafter are secured to one another using appropriate fasteners, not shown.

The mould halves are formed with formations which define the thread 40 around the outlet 38.

A settable material 72 is injected into the mould 60 through an inlet 74 provided in one of the mould halves. A preferred material is a relatively soft polyurethane 76 which is injected into the mould cavity and which fills the entire volume inside the mould cavity around the core assembly. The use of interengageable mould sections and the injection of a settable material into the mould cavity in the manner referred to, are known in the moulding art and are not further described herein.

Once the polyurethane has set the mould halves are released and the body is released from the mould sections. The core is then dissolved using a solvent such as acetone which acts on the polystyrene but which does not affect the polyurethane. The acetone with the entrained polystyrene is flushed from the cavity which has been defined by the core and is recovered for subsequent processing.

The valve member 26 is held captive inside the chamber 18 and is movable relatively thereto.

It is to be noted that the solvent is applied to those sections of the polystyrene core which are accessible from outside the body 12. Due to the use of the plastic pins 50 to 56 the polystyrene buoyancy component 22 is effectively embedded in the polyurethane and hence it is not exposed to the acetone solvent. Thus those core sections which define the mouth 30, the valve chamber 18, the tubes 14 and 16, and the outlet chamber 20, are flushed from the body. The polystyrene buoyancy component 22 is not attacked nor affected by the solvent.

After the body has been formed the spigot 44 is attached to the thread 40 using the union nut 42, in the manner described. One end of a flexible suction hose 80, see FIG. 1, is engaged with the spigot 44 and the other end of the hose is engaged with a suction connection of a swimming pool pump. The body is then placed in a swimming pool. When the pump is operated water is drawn through the mouth 30, through the valve chamber 18, down the tubes 14 and 16, and out of the body 12 exiting through the spigot 44 into the suction hose 80.

The valve member 26 has a wedge shape and a narrow end of the wedge rests in a recessed formation 82 defined by the moulding process. When water flows through the mouth 30 the valve member 26 oscillates to and fro inside the chamber 18, in a manner which is known in the art, and the water flow is alternately directed through the passages in the tubes 14 and 16. The resulting change in momentum of the flowing water and variation in the suction effect at the mouth 30 cause the cleaning device to move over a submerged surface in a random manner which, also, is known in the art. Dirt on the surface is entrained in the flowing water and is conveyed by the water to a filtration system. The filtered water is thereafter returned to the pool.

The aperture 36, if incorporated into the cleaner, provides an additional water flow path into the tubes 14 and 16.

It is to be noted that the body 12 is formed integrally without the use of screws or other fixing devices and does not consist of a number of parts which are connected to one another by means of fasteners. The valve member 26 is held captive, in a movable manner, inside the chamber 18. Labour requirements for assembly of the cleaning device are essentially eliminated. As there are no separate sections of the body which are secured to one another the likelihood of the body 12 breaking into separate sections, due to stresses which arise during operation of the device, is also reduced. This holds significant benefits for, by means of a single moulding process, the entire body of the pool cleaner is formed in a manner which permits join lines in the body to be eliminated.

In a first variation of the invention the polystyrene core sections are replaced by a different medium such as wax. The various core sections are moulded in wax using conventional techniques and are then used in an analogous manner during the moulding of the body. After the body has been moulded the wax core sections are melted by heating the wax to a molten stage at which the wax can flow from the body.

Clearly any other suitable dissolvable, flushable or meltable medium could be used in place of the polystyrene or wax to form the chambers and cavities inside the body.

Figure 4:
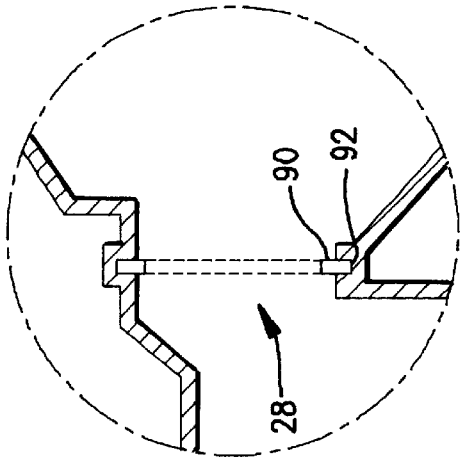
FIG. 4 is an enlarged view of a portion of a modified pool cleaning device according to the invention.

As has been noted the valve member 26 is preferably located inside the core so that it is left behind, inside the valve chamber 18, when the core is dissolved or melted as the case may be. This is not essential though for, after formation of the valve chamber 18, the valve member 26 could be forced through the inlet 28 into the chamber. This could be done in different ways. The material of the body 12, or of the valve member 26, or both, could be made from a flexible or deformable material which can be manipulated to allow the valve member to pass through the inlet. Another possibility is to define the restricted inlet 28 by means of a circlip 90 or any equivalent device, which is located in a groove 92 in the body, as is shown in FIG. 4. Initially the valve member can be passed through the inlet, into the chamber 18. With the circlip in position the valve member is held captive although it can be removed when required, for example for repair or service, simply by releasing the circlip.

In yet another variation the valve member is not formed beforehand. Instead the polystyrene or wax core, as the case may be, is formed with a cavity which defines the valve member. A small passage extends from the formation 82 to the narrow end of the wedge. When the polyurethane is injected into the mould the valve member is simultaneously formed together with a cleaner body, and is left behind, held captive in the valve chamber, when the core is dissolved or melted. The small amount of polyurethane material left behind in the passage does not adversely affect the operation of the cleaner and, in any event, is quickly worn away or abraded so that the valve member takes on the shape illustrated in FIG. 1.

The construction technique which has been described hereinbefore makes it possible to fabricate a pool cleaner body in a single moulding step and to eliminate join lines in the body. The body therefore is extremely strong and does not have formations or sections which can promote stress fractures. It is also possible to make the body from a relatively soft material. Sharp corners or formations which otherwise may have been largely unavoidable, when relying on injection moulding techniques, are eliminated. A further significant benefit lies in the fact that the mould requirements for moulding a material such as polyurethane are substantially less complex and expensive than the mould requirements for injection moulding. Although production rates may be somewhat lower when moulding polyurethane this possible disadvantage is more than offset by the substantially reduced fabrication costs and improved end product which results.

Figure 5:
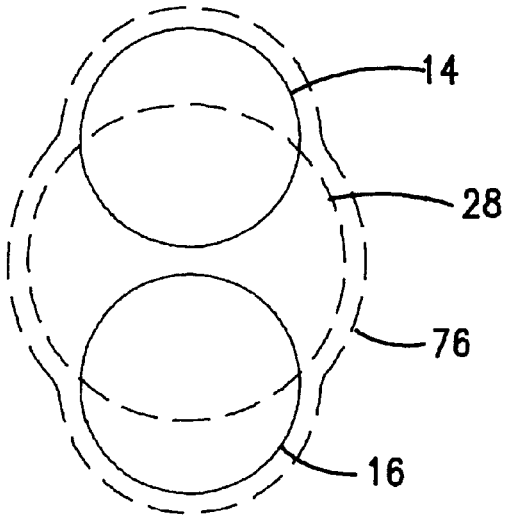
FIG. 5 is a cross-sectional illustration, substantially at right angles to the view shown in FIG. 1, depicting the shapes of tubes in the pool cleaning device.

FIG. 5 shows that each of the tubes 14 and 16 has a circular cross-section and, viewed in the axial direction of the tubes, the circular cross-sections overlie to a limited extent the inlet 28 near the mouth 30. Also, the outlet 38 only partly overlies the two tubes, viewed in the axial direction. Thus if foreign material becomes lodged inside the cleaning device 10 and causes an obstruction it may not necessarily be visible to an observer attempting to look axially down the tubes, from the outlet 38.

A second adverse aspect is that the quantity of polyurethane 76 required to fill the spaces between the tubes and impart to the body 12 an attractive profile, is substantial. Yet another drawback arises from the transition in shape, from the circular cross-sectional tubes to the chamber 18 which is, roughly speaking, rectangular in cross-section. Turbulence in the water flow and increased drag result, thereby increasing the suction effect, and hence power, required to draw water through the device at a particular flow rate.

Figure 6:
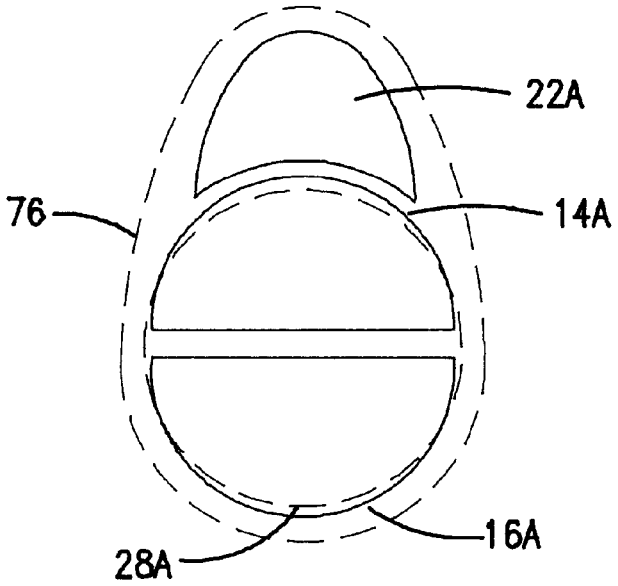
FIG. 6 is a view similar to FIG. 5 of a modified pool cleaning device with a preferred cross-sectional shape.

FIG. 6 shows preferred cross-sections for the tubes designated, in this case, 14A and 16A respectively. The tubes are D-shaped in cross-section and are positioned back-to-back so that a relatively thin wall of substantially constant cross-section separates the tubes.

A buoyancy component 22A, suitably moulded to reduce the wall thickness between the tube 14A and the component 22A, is positioned adjacent the tube 14A. The body 12 has an attractive shape, again with substantially constant wall thickness around the tubes and the component 22A.

The tubes 14A and 16A, in the axial direction, substantially overlap the area of the inlet 28A and the outlet 38. This is a significant benefit for it enables an obstruction within the body of the device to be seen, and be removed more readily.

Finally the transition between the tubes and the chamber 18 is smoother and, in a fluid dynamic sense, it creates less friction. The power requirement for a desired fluid flow rate through the device is therefore not materially enhanced.

Thus, although the tubes 14 and 16 could have any appropriate cross-sectional shape, the D-shaped cross-sections shown in FIG. 6 promote fluid flow efficiency, reduce material requirements for the body, and facilitate internal cleaning of the device.

Clearly, the polyurethane core required for the shapes shown in FIG. 6 is formed with a complementary shape to the internal volume of the cleaning device.

I claim:

1. A pool cleaning device comprising:

a unitary, one-piece body having a hollow valve chamber and an inlet to and an outlet from said valve chamber;

said unitary, one-piece body further having two longitudinal passages therethrough which are directly connected to said outlet from said valve chamber, each of said two passages having a D-shaped cross section with a common thin wall of substantially constant cross-section between them;

a valve member movably carried within said valve chamber; and a buoyant member embedded within said unitary, one-piece body and having a C-shaped cross section with a concave portion conforming to a convex portion of one of said D-shaped passages.

2. The device of claim 1, wherein said two D-shaped passages have a combined cross-sectional opening which is substantially the same size as and coaxial with said inlet to said valve chamber.

3. A pool cleaning device comprising:

a unitary, one-piece body having a hollow valve chamber and an inlet to and an outlet from said valve chamber;

said unitary, one-piece body further having two longitudinal passages therethrough which are directly connected to said outlet from said valve chamber, each of said two passages having a D-shaped cross section with a common thin wall of substantially constant cross-section between them;

a valve member movably carried within said valve chamber; and a weight member immovably embedded within said unitary, one-piece body.

* * * * *